US006688809B1

(12) United States Patent
Heinäsenaho

(10) Patent No.: US 6,688,809 B1
(45) Date of Patent: Feb. 10, 2004

(54) POWER TRANSMISSION ARRANGEMENT FOR A COMPUTER

(75) Inventor: Hannu Heinäsenaho, Jyväskylä (FI)

(73) Assignee: Oy Tanacorp LTD, Vaajakoski (FI)

( * ) Notice: Subject to any disclaimer, the term of this patent is extended or adjusted under 35 U.S.C. 154(b) by 0 days.

(21) Appl. No.: 10/009,115

(22) PCT Filed: May 26, 2000

(86) PCT No.: PCT/FI00/00473

§ 371 (c)(1),
(2), (4) Date: Nov. 8, 2001

(87) PCT Pub. No.: WO00/73595

PCT Pub. Date: Dec. 1, 2000

(30) Foreign Application Priority Data

May 28, 1999 (FI) ..... 991209

(51) Int. Cl.[7] ..... E02D 3/026
(52) U.S. Cl. ..... 404/117; 404/128
(58) Field of Search ..... 404/117, 122, 404/128

(56) References Cited

U.S. PATENT DOCUMENTS 3,670,631 A * 6/1972 Gaylor ..... 404/117
4,089,616 A 5/1978 Fairchild et al.
4,201,493 A 5/1980 Braun
4,313,691 A * 2/1982 Yargici ..... 404/117
4,568,218 A * 2/1986 Orzal ..... 404/117
4,632,599 A 12/1986 Sadahiro
5,164,641 A * 11/1992 Quibel et al. ..... 318/128
5,177,415 A * 1/1993 Quibel et al. ..... 318/128
5,248,216 A * 9/1993 Vural ..... 404/75
5,397,198 A * 3/1995 Bertrand ..... 404/117

FOREIGN PATENT DOCUMENTS

DE 3445398 6/1985

* cited by examiner

*Primary Examiner*—Gary S. Hartmann

(57) ABSTRACT

The invention discloses a power transmission arrangement for a compactor, in which a roller is installed to both end-pieces of a roller frame. In both end-pieces, there are bearing assemblies supporting the roller. In addition, in at least one end of the roller there is a hub motor, which is arranged to rotate the roller. The bearings of the hub motor form the bearing assembly supporting the end of the roller. In addition, the roller is supported from the end-piece with the aid of the hub motor and a universal joint. The universal joint transmits moment and permits a variation in the angle between the roller and the end-piece.

6 Claims, 3 Drawing Sheets

POWER TRANSMISSION ARRANGEMENT FOR A COMPUTER

TECHNICAL FIELD

The present invention relates to a power transmission arrangement for a compactor, in which a roller is installed rotatably by its ends in the end-piece of each roller frame, in such a way that, in each end-piece, the end of the roller is supported in bearings, and at least in one end of the roller there is a ready-made hub motor, which is arranged to rotate the roller, and which hub motor includes, at opposite attachment ends, a casing and a flange, and, between them, bearings that restrain the attachment ends axially, which bearings form the bearing assembly of the aforesaid roller.

BACKGROUND OF THE INVENTION

Compactors according to the invention are used to effectively compact materials and to crush material. Due to this, the compactors are heavy and have cylindrical rollers as wheels. On account of the large masses and slow driving speed, hydrostatic transmissions are preferably used in the compactors. Usually, the compactor's diesel engine is used to rotate one or more hydraulic pumps. The hydraulic pumps are used in turn to rotate hydraulic motor units arranged to rotate the rollers. Normally, there is at least one hydraulic motor unit in connection with each roller.

In compactors, the roller is support rotatably by means of bearing assemblies in the end-pieces of the roller frame. In small and narrow compactors, it is relatively easy to locate the hydraulic motor unit directly in the end of the roller, as disclosed in U.S. Pat. No. 4,089,616, for example. Often, only a low-speed hydraulic motor is used as the hydraulic motor unit in small compactors. In larger compactors, the power required is considerable, so that, in addition to the hydraulic motors, some form of gearbox is required. By locating the hydraulic motor, the gearbox, and the bearing assembly in the end of the roller, the compactor's transmission arrangement becomes complicated and expensive. At the same time, the transmission arrangement requires a great deal of space for installation. In addition, in large compactors, it is difficult to align a hub motor, which is as such known, with the axis of rotation of the roller. Thus, in large rollers, the chain-drive arrangement according to publication U.S. Pat. No. 4,854,772 is generally used.

SUMMARY OF THE INVENTION

The invention is intended to create a compactor transmission arrangement, which is simpler than previous arrangements and in which ready-made components can be utilized. A power transmission arrangement for a compactor, in which a roller is installed rotatably by its ends in both end-pieces of a roller frame, in such a way that there are bearing assemblies supporting the end of the roller in both end pieces, and, in at least one end of the roller there is a ready-made hub motor, which is arranged to rotate the roller, and which hub motor includes a casing and a flange as opposing attachment ends, with bearings between them, axially securing the attachment ends, and forming a bearing assembly supporting the end of the aforesaid roller, is characterized in that the roller is supported from the end-piece with the aid of the aforesaid hub motor, in such a way that one of the attachment ends is secured to the end of the roller and the opposite attachment end is secured to the end-piece, and that in one attachment end there is an effective universal joint, which transmits moment and permits a variation in the angle between the roller and the end-piece.

In one arrangement the hub motor and universal joint are arranged in both ends of the roller. The universal joint comprises a first fork construction attached to one attachment end; a second fork construction attached to the construction opposite to the attachment end, to either the end-piece or to the end plate of the roller, at an angle of 90° in relation to the first fork construction; and a crosspiece connecting the fork constructions, which is attached to each fork construction with the aid of two pairs of joints, which pairs of joints are essentially in the same plane. The hub motor is stiffly attached by its casing to the end plate of the roller.

A plate construction is attached to the flange, which supports two joints arranged symmetrically in relation to the axis of rotation of the roller and at a distance from each other, thus forming the first pair of joints for carrying the crosspiece, and the end-piece is supported by means of two joints forming a second pair of joints arranged symmetrically in relation to the projection of the axis of rotation of the roller, the second joints being in turn supported with the aid of the aforesaid crosspiece. The crosspiece is formed by a circular ring arranged around the hub motor, which includes the joint pins of the aforesaid pairs of joints. A roller transmission arrangement according to the invention is arranged centrally on the axis of rotation of the roller. This also protects the transmission arrangement, which is preferably assembled from standard components, inside the roller. In addition, the roller is supported in such a way that bearings that specifically support the roller are not required in the compactor, which further simplifies the construction of the compactor's transmission arrangement. The transmission arrangement also does not limit the maximum width of the compactor.

In the following, the invention is explained in detail, with reference to the accompanying drawings, depicting one embodiment of the invention, in which

DETAILED DESCRIPTION OF THE INVENTION

Figure 1A:
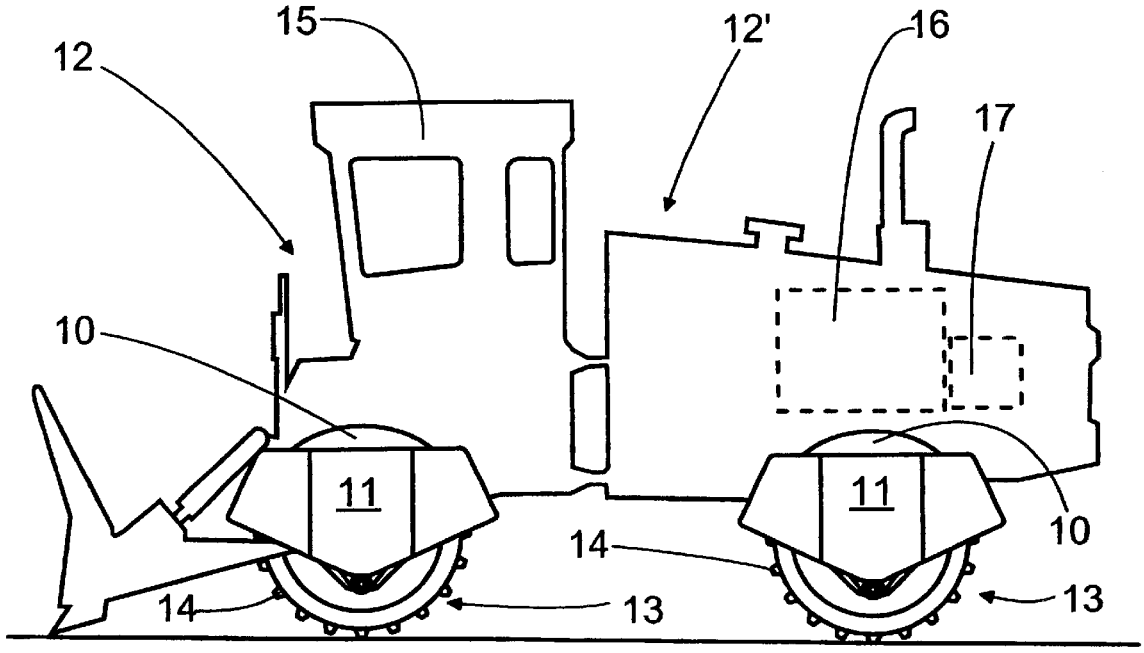
FIG. 1*a* shows a side view of a compactor equipped with a transmission arrangement according to the invention.

FIG. 1*a* shows a simplified side view of a landfill compactor equipped with a transmission arrangement according to the invention. In this case, the compactor includes a chassis-steered base and roller frames 10 arranged in both of its chassis sections 12 and 12'. Cylindrical rollers 13 are supported in the end-pieces 11 of the roller frame 10, with the aid of two bearing assemblies. In rollers 13, there are also spinous protrusions 14, which improve the crushing and compacting effect of the landfill compactor. Hydraulic motor units (not shown) are also arranged to rotate the rollers 13. The construction of a hydraulic motor unit is shown in greater detail in connection with FIG. 2. In the front chassis section 12 there is a driving cab 15 and in the rear chassis section 12' there is an engine 16, with its ancillary devices and fuel tanks. In addition, one or more hydraulic pumps 17 are connected to engine 16, these being connected by suitable pipe lines to the hydraulic motor units arranged to rotate the rollers 13, in order to drive the compactor. The transmission arrangement according to the invention can also be applied to compactors other than landfill compactors.

Figure 1B:
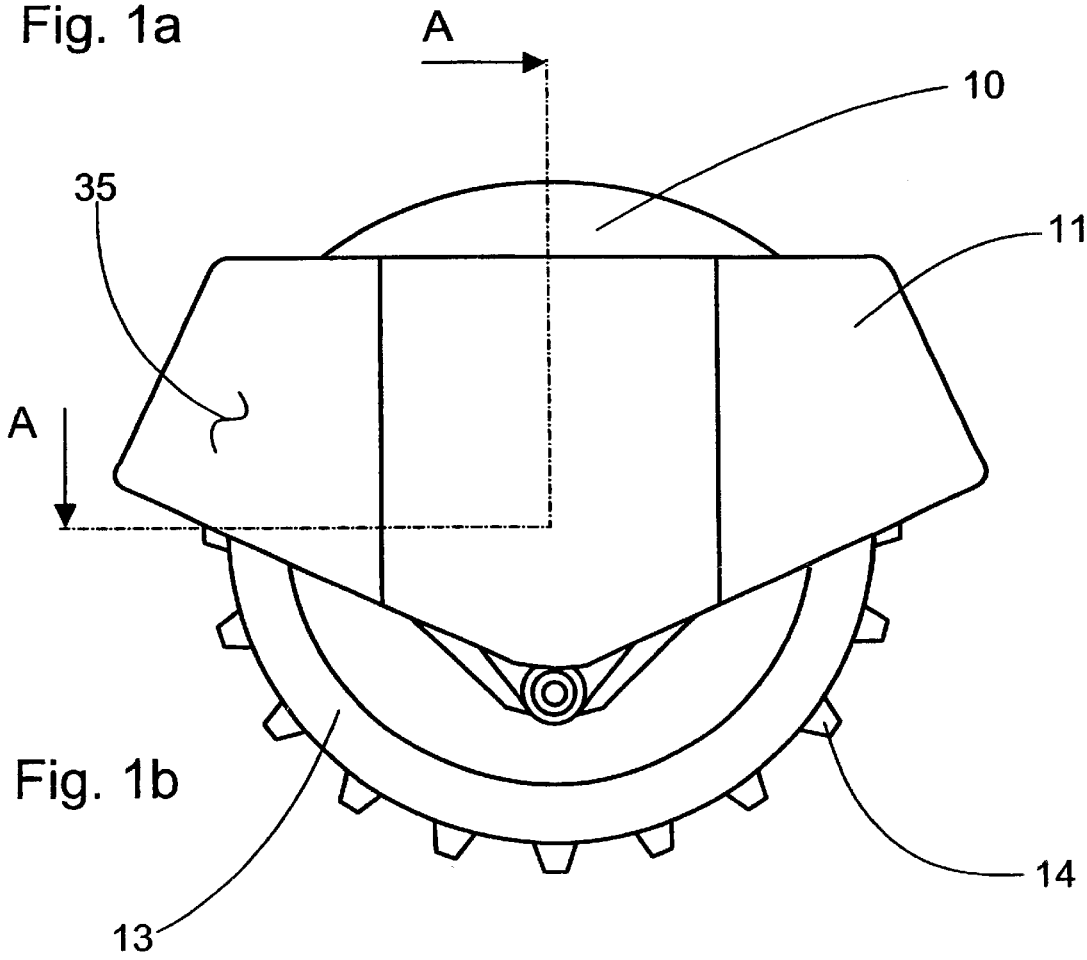
FIG. 1*b* shows a side view of a roller construction incorporating a transmission arrangement according to the invention.
Figure 2:
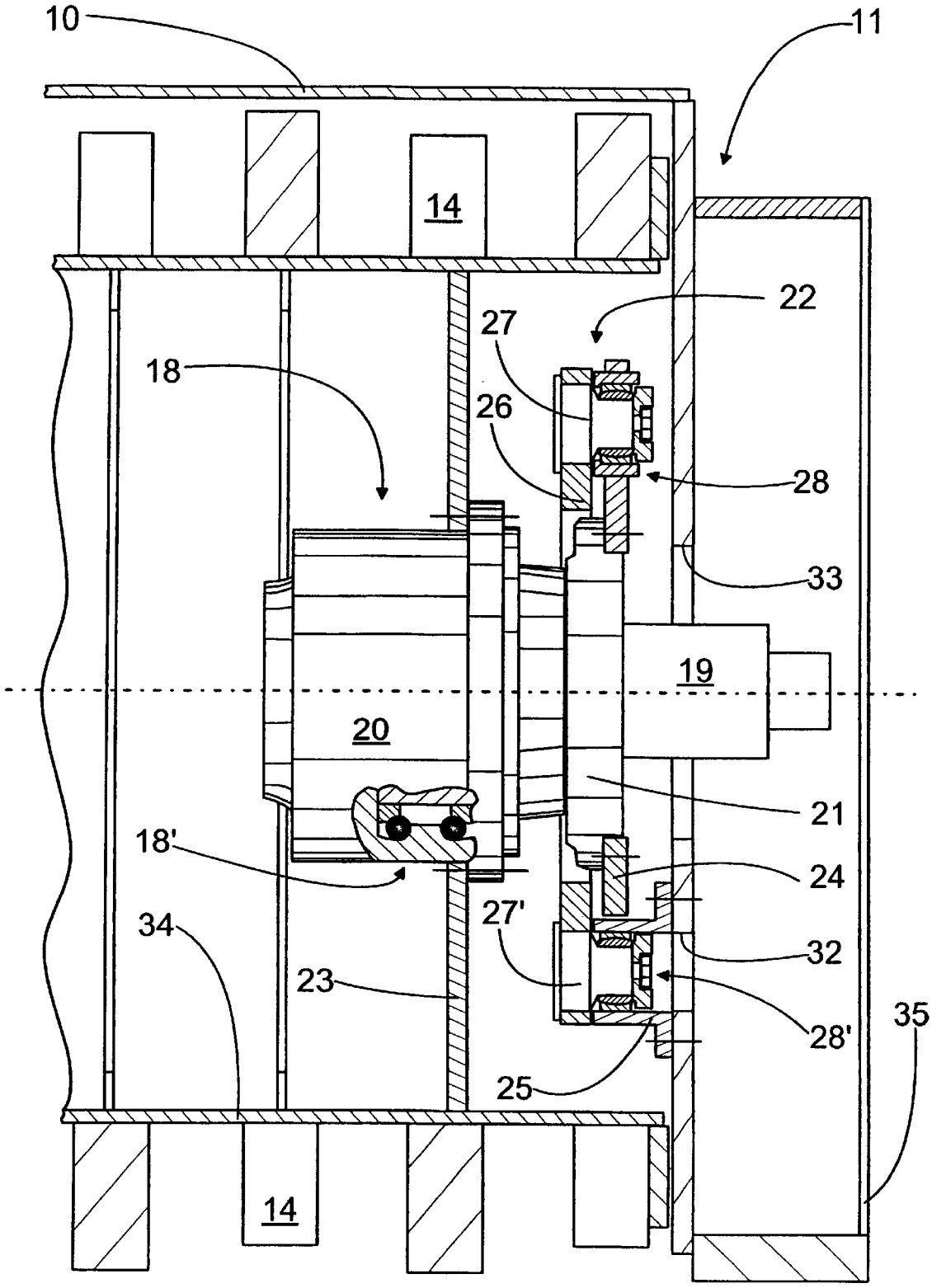
FIG. 2 shows a cross-section, on planes A—A, of the roller on FIG. 1*b* and its transmission arrangement.

FIG. 1*b* shows in greater detail one roller frame 10 and roller 13, which is supported rotatably in its end-pieces 11. In addition, only the outer row of protrusions 14 is shown. A cross-section of FIG. 1*b* is shown in FIG. 2, which combines both a vertical and a horizontal cross-section.

According to the invention, the hydraulic motor unit of the compactor is a ready-made hub motor 18, which is as such known. Alternatively, a conventional roller gear with a hydraulic motor installed in it, as shown in FIG. 2, can be used. Other combinations are also possible. In-hub motors, there is usually a planet gearbox, permitting the use of a high-speed standard hydraulic motor, unless the hub motor itself already contains a motor. This substantially simplifies the compactor's transmission arrangement and simultaneously reduces the cost of purchasing and maintaining the compactor. In a known manner, hub motor 18 includes a casing 20 and a flange 21 as opposing attachment ends, with bearings 18' that axially secure the attachment ends set between them. According to the invention, the aforesaid bearings 18' also form the bearing assemblies of roller 13. This further simplified the construction of the compactor's transmission arrangement. Generally, roller 13 is supported from end-pieces 11 with the aid of the aforesaid hub motor 18, in such a way that one attachment end is secured to the end of roller 13 and the opposing attachment end is secured to end-piece 11.

According to the invention, the bearings 18' of hub motor 18 form precisely the bearing assemblies of roller 13. Thus, separate bearing assemblies are not required at the ends of the roller. In principle, the hub motor could be attached stiffly to both roller 13 and end-piece 11. However, when the compactor is driven, a wide roller will inevitably deflect to some extent, which will impose excessive stresses on the bearings of the hub motor. On account of this, according to the invention, hub motor 18 incorporates, in attachment end 20 or 21, an effective universal joint 22, which transmits a moment and permits a variation in angle. Thus, the bearings 18' of hub motor 18 are fully sufficient as the only bearing assemblies of roller 13.

The use of a hub motor and its axially securing bearings as the only bearing assembly of the roller is thus possible, because, according to the invention, roller 13 is supported from end-piece 11 through the effective universal joint 22. The universal joint also permits the variation in angle caused by the deflection of the roller, without excessively loading the bearings. Generally, there is a transmission arrangement according to the invention in at least one end of each roller. Thus, at the end without a motor, there is a simple bearing assembly, which permits a variation in angle. Preferably, self-aligning ball-like rolling bearings are used. The power of the compactor can be easily increased by arranging a hydraulic motor unit and universal joint at both ends of the roller.

There are various alternatives ways of attaching the hub motor. The hub motor may be stiffly attached to the end plate of the roller, either by its casing or by a flange arranged to rotate in relation to it. Alternatively the hub motor may be stiffly attached to the end-piece either by its casing or by its flange. The roller gear 18 of FIG. 2 is stiffly attached to end plate 23 of roller 13, so that most of the roller gear 18 is located inside end plate 23 of roller 13, where there is plenty of installation space. Threaded joints are preferably used for the attachment. The individual pairs of nuts and bolts are not shown.

According to the invention, the roller is supported from the end-pieces, by means of a hub motor and the effective universal joint connected to it. Generally, a universal joint with a known mechanism comprises two fork constructions and a crosspiece. However, the universal joint according to the invention is implemented in practice using components of various kinds. In this case, one fork construction is attached to one attachment end 20 or 21 of hub motor 18. Correspondingly, the other fork construction is attached to the structure opposite to attachment end 20 or 21 of hub motor 18, in this case, to either end-piece 11 or end plate 23 of roller 13. In addition, the second fork construction is set at an angle of 90° to the first fork construction. The crosspiece 26 connected to the fork constructions is attached to each fork construction by means of two pairs of joints 28 and 28'. The pairs of joints 28 and 28' are additionally essentially on the same plane.

To create the universal joint, plate construction 24 is attached to flange 21. The plate construction symmetrically carries two joints set at a distance in relation from the axis of rotation of roller 13, forming the first pair of joints 28 for carrying crosspiece 26. In addition, end-piece 11 is supported symmetrically with the aid of two joints forming the second pair of joints 28' placed in relation to the projection of the axis of rotation of roller 13. The joints in question are in turn support with the aid of the aforesaid crosspiece 26.

Crosspiece 26 is preferably formed by a circular ring arranged around hub motor 18, which ring includes the joint pins 27 and 27' of the aforesaid pairs of joints 28 and 28'. Pairs of joints 28 and 28' are preferably ball joints, which form the effective bearings of the universal joint. In the example, the horizontal pair of joints 28' of the crosspiece is fitted by means of two securing devices 25 stiffly attached to the end-piece 11. Securing devices 25 are preferably in turn fitted to end-piece 11 by means of threaded joints. Instead of ball joints, some other support that permits the mutual movement of the crosspiece and the plate construction can be used. In FIG. 2, crosspiece 26 is fitted to plate construction 24 on the roller 13 side, when the total length of the transmission arrangement will be as short as possible. Thus, a solution according to the invention will form a joint construction, which permits variation of the angle between the roller and the end-piece. The construction is, however, stiff in both the axial and radial directions and can transmit even large moment.

Various forces and moments are transmitted from the end-piece to the roller through the hub motor and the universal joint. In the example of a solution according to FIG. 2, the force through the securing devices 25 attached to end-piece 11 is transmitted through the horizontal pair of joints 28' to crosspiece 26. From crosspiece 26, the force is transmitted in turn through the vertical pair of joints 28 to plate construction 24. From plate construction 24, the force continues by means of flange 21 to casing 20 and from it in turn through end plate 23 to roller 13. Thus, the rotational movement of the hub motor is transmitted to the roller and the hub-motor bearings can be used as the only bearings, as the universal joint permits the variation of the angle of the roller.

Figure 3A:
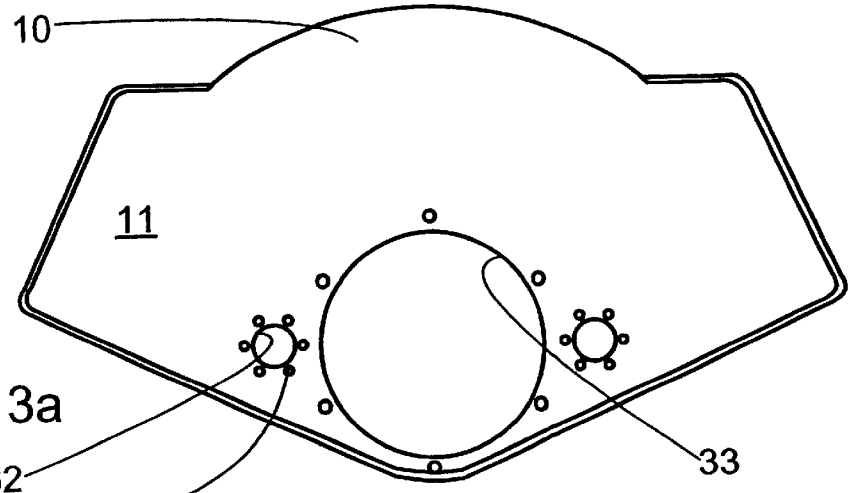
FIGS. 3*a*–3*c* show side views of a roller construction incorporating the transmission arrangement according to the invention, dismantled into its principal components.
Figure 3B:
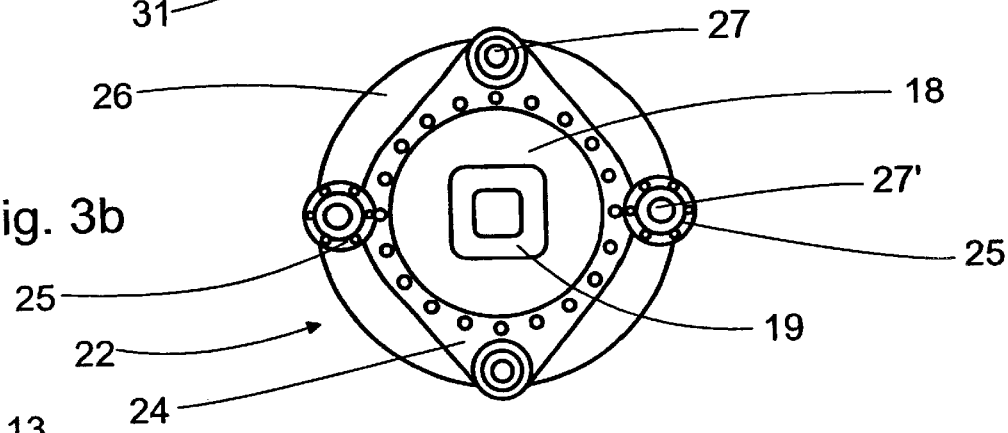
Figure 3C:
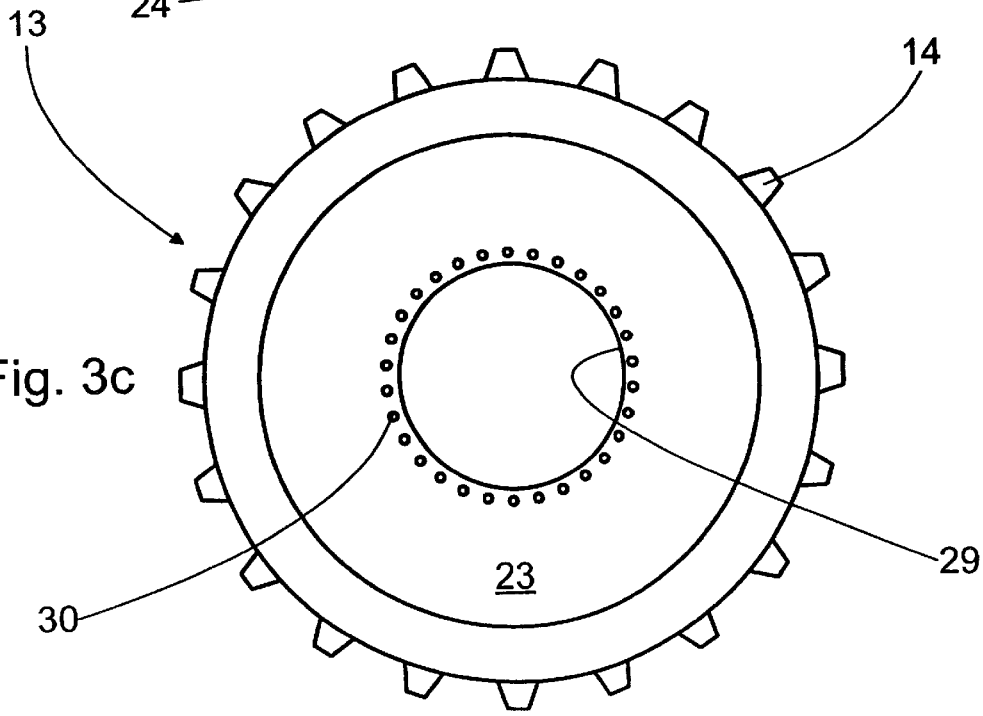

FIGS. 3*a*–3*c* show a roller construction according to the invention and its principal components separated from one another. In FIG. 3*c* shows roller 13, which has an opening 29 in its end plate 23 made for the hub motor. There is a suitable number of holes 30 drilled around opening 29 for attaching the hub motor to roller 13. In addition, end plate 23 is arranged to be slightly sunk inside roller shell 34, so that essentially the entire transmission arrangement will fit inside roller 13. In FIG. 3*b*, there is a component formed by hub motor 18 and universal joint 22, which can be assembled prior to the assembly of the actual compactor. In the example, the component is first attached by means of the hub motor to roller 13. Next, roller 13 and roller frame 10 are fitted together and securing devices 25 are attached to end-piece 11. For this purpose, a suitable number of holes 31 are drilled in end-piece 11 (FIG. 3*a*). Ball joints 28' can be inspected and serviced through the smaller openings 32 in end-piece 11. In the example, hydraulic motor 19 protrudes from the larger opening 33 in end-piece 11. A protective cap can be fitted over the large opening 33. In the same way, a protective cover 35, under which are the connections of hydraulic motor 19, can finally be placed over the entire end-piece 11.

The compactor transmission arrangement according to the invention is considerably simpler than previous arrangements. It also allows the use of standard components, which facilitates the maintenance of the compactor. The transmission arrangement also does not limit the maximum width of the roller. For example, instead of a universal joint, a flexible ring construction can be used, by means of which one attachment end of the hub motor is supported. Correspondingly, the universal joint can be replaced, for example, with a construction similar to a constant-angular-velocity joint. A solution according to the invention can also be used in connection with other things than the rollers described. However, in compactor use, the simplicity and space-saving achieved are significant advantages.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A power transmission arrangement for a compactor, including a roller having roller ends installed rotatably by the ends in both end-pieces of a roller frame, bearing assemblies supporting the ends of the roller in both end pieces, and a hub motor being in at least one end of the roller arranged to rotate the roller, the hub motor including a casing and a flange as opposing attachment ends, with bearings therebetween axially securing the attachment ends and forming a bearing assembly supporting the end of the roller, characterized in that the roller is supported from the end-piece with the aid of the hub motor, one of the attachment ends being secured to the end of the roller and the opposite attachment end being secured to the end-piece, and a universal joint being in one attachment end which transmits movement and permits a variation in the angle between the roller and the end-piece.

2. A power transmission arrangement according to claim 1, characterized in that a hub motor and universal joint are arranged in both ends of the roller.

3. A power transmission arrangement according to claim 1 characterized in that the universal joint comprises a first fork construction attached to one attachment end, a second fork construction attached to the construction opposite to the attachment end, to either the end-piece or to the end plate of the roller, at an angle of 90° in relation to the first fork construction, and a crosspiece connecting the fork constructions, which is attached to each fork construction with the aid of two pairs of joints, which pairs of joints are essentially in the same plane.

4. A power transmission arrangement according to claim 3, characterized in that the hub motor is stiffly attached by its casing to the end plate of the roller.

5. A power transmission arrangement according to claim 3, characterized in that a plate construction is attached to a flange, which supports two joints arranged symmetrically in relation to the axis of rotation of the roller and at a distance from each other, forming the first pair of joints for carrying the crosspiece, and that the end-piece is supported by two joints forming a second pair of joints arranged symmetrically in relation to the projection of the axis of rotation of the roller, the second joints being supported with the aid of the crosspiece.

6. A power transmission arrangement according to claim 3 characterized in that the crosspiece is formed by a circular ring arranged around the hub motor, which includes the joint pins of the aforesaid pairs of joints.

* * * * *

UNITED STATES PATENT AND TRADEMARK OFFICE

CERTIFICATE OF CORRECTION

PATENT NO. : 6,688,809 B1
DATED : February 10, 2004
INVENTOR(S) : Hannu Heinasenaho It is certified that error appears in the above-identified patent and that said Letters Patent is hereby corrected as shown below:

Title page,
Item [54], Title, "COMPUTER" should read -- COMPACTOR --.
After Item [56], add the line [74] -- *Attorney, Agent, or Firm*, Fildes & Outland, P.C. --.

Signed and Sealed this

Sixth Day of April, 2004

JON W. DUDAS
*Acting Director of the United States Patent and Trademark Office*